US008919027B2

(12) United States Patent
Curry

(10) Patent No.: US 8,919,027 B2
(45) Date of Patent: Dec. 30, 2014

(54) FIREARM AND AIR GUN SIGHT

(71) Applicant: Michael Curry, Henderson, NV (US)

(72) Inventor: Michael Curry, Henderson, NV (US)

( * ) Notice: Subject to any disclaimer, the term of this patent is extended or adjusted under 35 U.S.C. 154(b) by 0 days.

(21) Appl. No.: 13/792,703

(22) Filed: Mar. 11, 2013

(65) Prior Publication Data

US 2013/0255129 A1 Oct. 3, 2013

Related U.S. Application Data

(60) Provisional application No. 61/609,435, filed on Mar. 12, 2012.

(51) Int. Cl.
*F41G 1/00* (2006.01)
*F41G 1/42* (2006.01)
*F41G 1/10* (2006.01)

(52) U.S. Cl.
CPC ... *F41G 1/00* (2013.01); *F41G 1/10* (2013.01); *F41G 1/425* (2013.01)
USPC ..... 42/133; 42/144

(58) Field of Classification Search
CPC ..... F41G 1/00; F41G 1/01; F41G 1/06; F41G 1/03; F41G 1/10; F41G 1/32
USPC ..... 42/111–148
See application file for complete search history.

(56) References Cited

U.S. PATENT DOCUMENTS 985,181 A * 2/1911 Korrodi ..... 42/144
1,718,458 A * 6/1929 Hager et al. ..... 42/144
3,777,380 A * 12/1973 Theodore ..... 42/144
4,850,113 A * 7/1989 Doll ..... 42/130
6,058,616 A * 5/2000 Bubits ..... 42/144
6,321,479 B1 * 11/2001 Sheehan ..... 42/111
6,711,846 B1 3/2004 Nasef
D489,115 S 4/2004 Nasef
7,451,566 B1 * 11/2008 Price ..... 42/133
7,832,138 B1 * 11/2010 Price ..... 42/144

(Continued)

OTHER PUBLICATIONS

Screen shots from the homepage of www.advantagetactical.com printed on Mar. 11, 2013.

*Primary Examiner* — Michael Carone
*Assistant Examiner* — Jonathan C Weber
(74) *Attorney, Agent, or Firm* — Michael A. Blake

(57) ABSTRACT

A firearm sight comprising: a sight base; a left contrast geometry wall extending generally upward from the sight base, the left contrast geometry wall having a left operator end and a left firing end; a right contrast geometry wall extending generally upward from the sight base, the right contrast geometry wall having a right operator end and a right firing end, and where the left contrast geometry wall and right contrast geometry wall are tapered in position with respect to each other such that distance between the left operator end and the right operator end is greater than the distance between the left firing end and the right firing end; a targeting space located generally between left and right firing ends; a mounting interface attached to the underside of the base, and configured to attached to a top surface of a firearm; where the left and right contrast geometry walls each have an inner surface that has a visually contrasting appearance such that user intuitively adjusts the firearm such that the contrast geometry on the left wall and the contrast geometry on the right wall appear to the user to be symmetrical, equal in size and shape, and of a particular orientation, when the user properly aims the firearm at a target.

13 Claims, 17 Drawing Sheets

(56) References Cited

U.S. PATENT DOCUMENTS

| | | | | |
|---|---|---|---|---|
| 7,934,334 | B2 * | 5/2011 | Kraft | 42/111 |
| 7,946,075 | B2 | 5/2011 | Nasef | |
| 8,037,634 | B2 * | 10/2011 | Price | 42/133 |
| 8,104,218 | B2 * | 1/2012 | McCann | 42/144 |
| 2011/0067286 | A1 * | 3/2011 | Price | 42/111 |
| 2012/0198750 | A1 * | 8/2012 | Mansfield | 42/132 |

* cited by examiner

FIREARM AND AIR GUN SIGHT

CROSS-REFERENCES

This patent application claims the benefit of provisional patent application Ser. No. 61/609,435 by Michael Curry, entitled "Firearm and Airgun Sight", filed on Mar. 12, 2012, the entire contents of which are fully incorporated by reference herein.

TECHNICAL FIELD

The present invention relates to sights for firearms and air guns, and more specifically to a sights with a contrast geometry.

BACKGROUND

There exists firearm and air gun sights in the prior art, such as post-and-notch sight systems. However these prior art sights may take excessive time to acquire the target, may be less precise, and less intuitive than necessary for a quick and accurate acquisition of the target in a potentially life and death situation.

Therefore, there is a need for a firearm and/or air gun sight that overcomes the above and other disadvantages.

SUMMARY OF THE INVENTION

The disclosed invention relates to a firearm sight comprising: a sight base; a left contrast geometry wall extending generally upward from the sight base, the left contrast geometry wall having a left operator end and a left firing end; a right contrast geometry wall extending generally upward from the sight base, the right contrast geometry wall having a right operator end and a right firing end, and where the left contrast geometry wall and right contrast geometry wall are tapered in position with respect to each other such that distance between the left operator end and the right operator end is greater than the distance between the left firing end and the right firing end; a targeting space located generally between left and right firing ends; a mounting interface attached to the underside of the base, and configured to attached to a top surface of a firearm; where the left and right contrast geometry walls each have an inner surface that has a visually contrasting appearance such that user intuitively adjusts the firearm to cause the contrast geometry on the left wall and the contrast geometry on the right wall to appear symmetrical, equal in size and shape, and of a particular orientation, when the user properly aims the firearm at a target.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
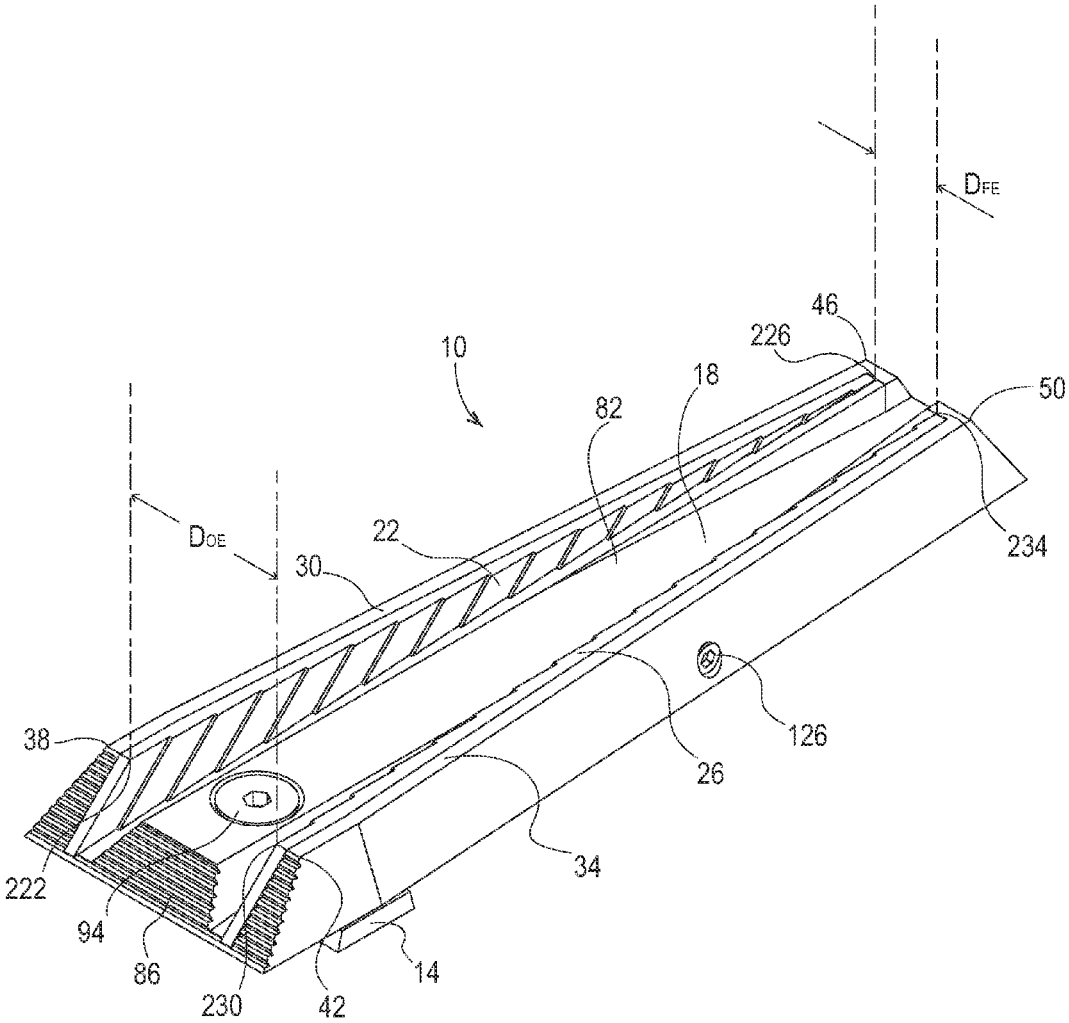
FIG. 1 is an isometric upper perspective view of the elements of one embodiment.

Referring to FIG. 1, one embodiment of the sight 10 is shown. The sight is attachable to a firearm or air gun via the mounting interface 14. Please note that for the remainder of this document, the term firearm shall apply to firearms, air guns, and any other device that may require target sighting. The sight 10 is comprised of three major components: a base 18, a left contrast geometry wall 22 and a right contrast geometry wall 26, and the mounting interface 14. The left contrast geometry wall 22 has a left operator end 222 and a left firing end 226. The right contrast geometry wall has a right operator end 230 and a right firing end 234. The left contrast geometry wall 22 and right contrast geometry wall 26 are tapered in position with respect to each other such that distance between the left operator end and the right operator end $D_{OE}$ is greater than the distance between the left firing end and the right firing end $D_{FE}$.

Figure 2:
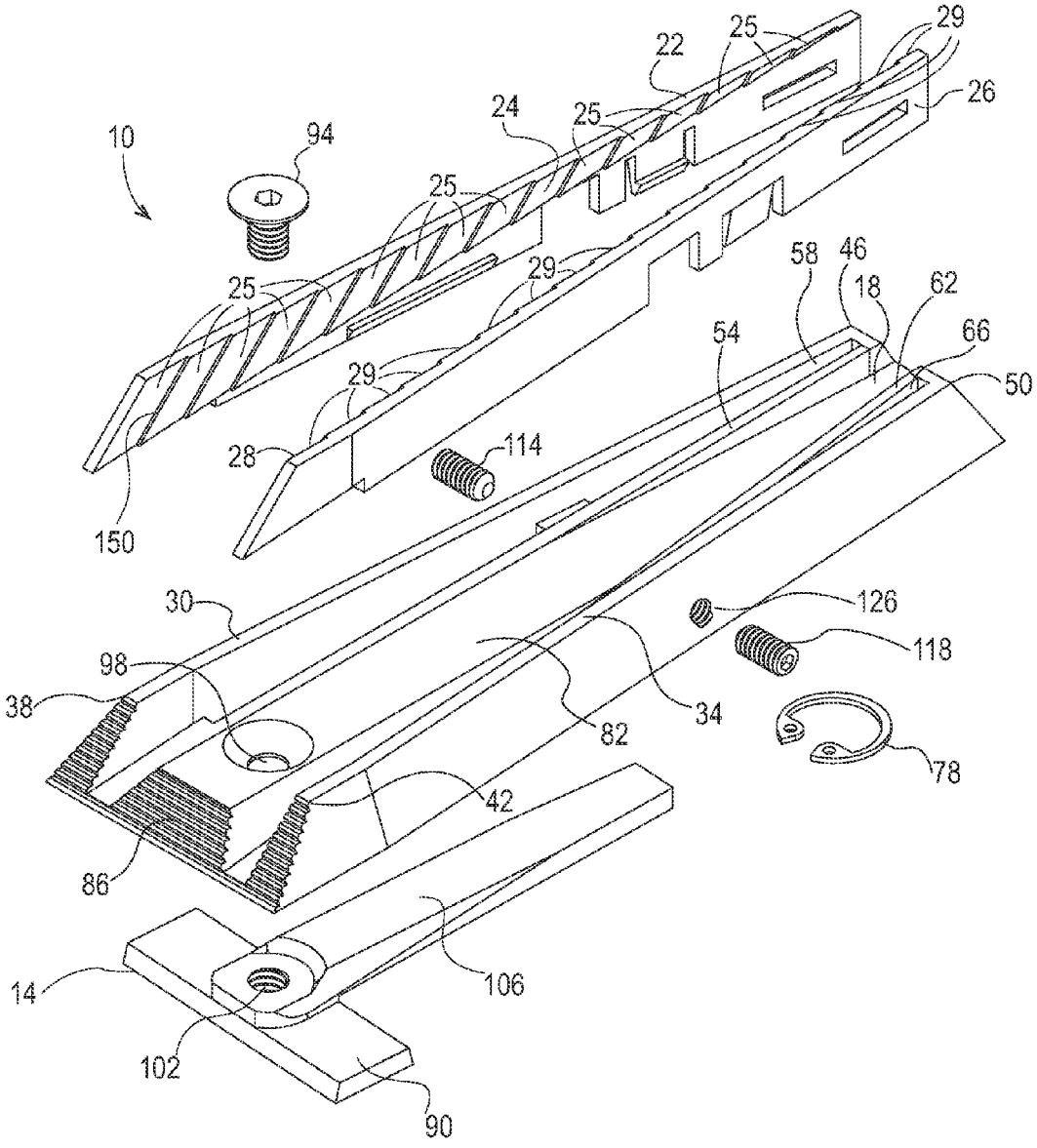
FIG. 2 is an exploded view of one embodiment.

Referring now to FIG. 2 which is a generally exploded view of the sight 10 from FIG. 1, the base 18 is configured to hold the geometric framework for the sight 10, with a left wall structure 30 and a right wall structure 34 that extend generally vertically from the level plane of the upper surface 82 of the base 18. In addition the wall structures 30, 34 are tapered, such that the space between operator ends 38, 42 of the wall structures 30, 34 (respectively) is larger than the space between the firing ends 46, 50 of the wall structures 30, 34, respectively. The left wall structure 30 comprises a left slanted ramp 54 and a left slot 58. The right wall structure 34 also comprises a right slanted ramp 62 and right slot 66. Note how the ramps 54, 62 rise in elevation from the from the operator ends of the walls 38, 42 to the firing ends of the walls 46, 50. In this embodiment, Left wall 22 is configured to slide into and removeably lock into the left slanted ramp 54 and left slot 58. Thus in this embodiment, left wall 22 may also be referred to as a left tab 22. Right wall 26 is configured to slide into and removeably lock into the right slanted ramp 62 and slot 66, similarly, right wall 26 may also be referred to as a right tab 26. When the tabs 22, 26 are seated into the slots 58, 66 they form the desired geometry scheme against the backdrop of the wall structures 30, 34. The tabs may be secured onto the base using a variety of means, including adhesives, snap joints, latches, clips, retaining rings, pins, screws, press-fit/interference-fit, or any other attachment means that appropriately secures the tabs 22, 26 with respect to the base 18. In one embodiment, the tabs are secured onto the base using a combination of integrated snap-fit joints, latches, and an internal retaining ring 78. The front (operator) end 86 of the base 18 may have a serrated surface to reduce glare and otherwise enhance the visual qualities of the sight. The left tab 22 and right tab 26 have a geometry that helps guide an operator's line of sight to the target. For instance, the inner surface 28 of right tab 26 comprises a plurality of surfaces 29, beginning on the operator end 42 and moving towards the firing end 50, each subsequent surface 29 is slightly raised with respect to the previous surface 29. Similarly, the inner surface 24 of left tab 22 comprises a plurality of surfaces 25, beginning on the operator end 38 and moving towards the firing end 46, each subsequent adjacent surface 25 is slightly raised with respect to the previous adjacent surface 25. The height of each surface 25, 29 become smaller as one travels away from the operator ends 38, 42 towards the firing ends 46, 50. This geometry, when looked down upon as an operator would when lining up his sight 10, provides a unique targeting surface, as will be discussed with respect to FIG. 6.

Figure 3:
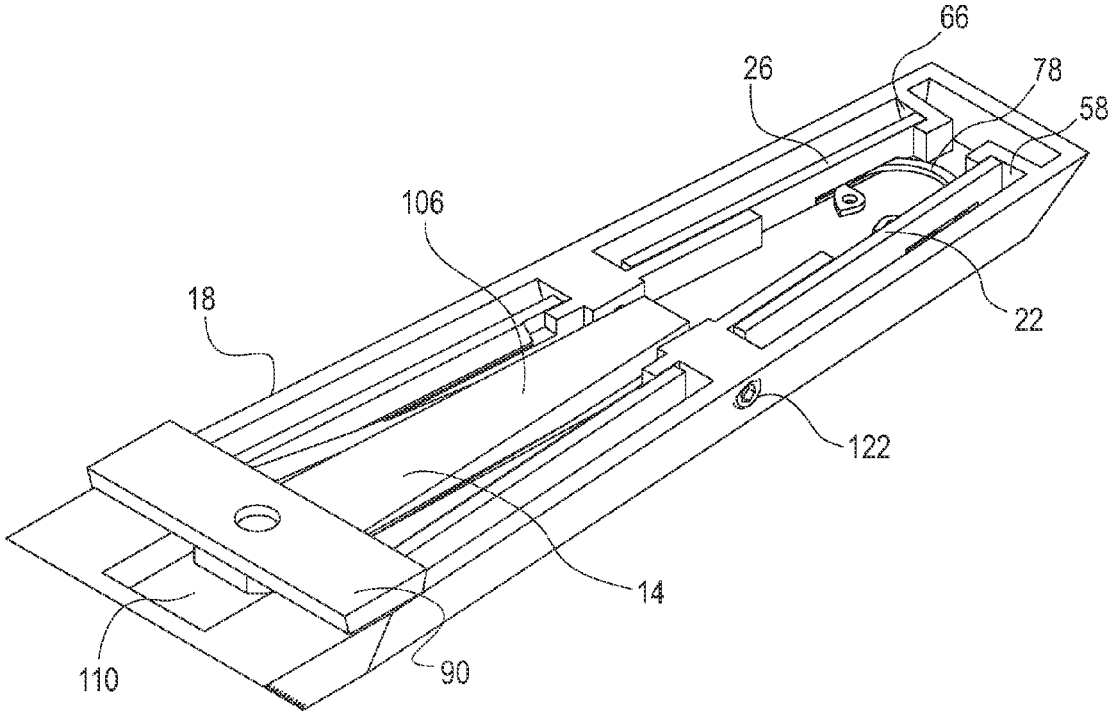
FIG. 3 is an isometric bottom perspective view of the elements of one embodiment.
Figure 4:
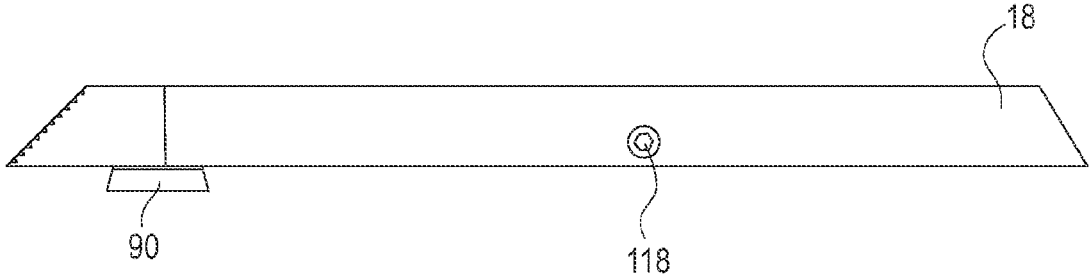
FIG. 4 is a side view of one embodiment.

Referring now to FIG. 3, the bottom of the base from FIG. 2 is designed to accommodate the joints, latches and retaining ring 78. FIG. 4 is a side view of the sight 10.

The sight 10 is secured onto the firearm through a mounting interface 14. In one embodiment, the interface 14 is configured for a firearm that utilizes a dovetail mounting scheme for sight attachment, wherein a dovetail mounting tab 90 is designed and shaped for a corresponding dovetail slot of a firearm. The disclosed invention encompasses the various mounting interfaces that may accommodate the numerous sight mounting schemes used by the different firearms. Accordingly, the designs of the mounting interface 14 and, in particular, the nature of the mounting tab 90, will likely be very different for different firearms, depending on the sight mounting scheme in question.

To secure the sight 10 onto a gun, mounting screw 94 is inserted through mounting hole 98 of the base 18 and screwed into threaded hole 102 of the mount 14. In the case of the dovetail mounting embodiment shown in FIG. 2, the screw 94 will compress the base 18 and dovetail mounting tab 90 towards each other, allowing the base 18 to secure against the top of the gun while the dovetail mount tab 90 pushes upwardly against the sides of the dovetail slots in the firearm (not shown, but well known in the art). The compression force between the base 18 and dovetail mounting tab 90 sandwiches the ledges of the dovetail slot in the firearm (not shown), thus securing the base 18 and mount 14 onto the firearm.

Referring now to FIGS. 2 and 3, integrated with the mounting interface 14 is a perpendicular extension arm 106 that serves to adjust and secure the base rotationally with respect to the firearm. It is shaped to fit inside the bottom cavity 110 of the base 18, with sufficient margin for small movement. As the 106 arm is rotationally fixed with respect to the firearm, it is able to a provide a mechanical reference for the base, which is not rotationally fixed and can rotate about the axis created by screw 94 threaded into hole 102. To fix the base 18 rotationally with respect to the mounting interface 14, two set screws 114 and 118 are threaded into holes 122 and 126 in the sides of the base 18, which secure against the respective sides of extension arm 106 located inside cavity 110. By tightening the set screws 114, 118 against both sides of extension arm 106, the base 18 becomes rotationally fixed with respect to the extension arm 106. Further, its angular position can then be adjusted by changing the depth of each set screw 114, 118, which accordingly alters the angle of the base 18 with respect to the extension arm 106. For instance, loosening one set screw an incremental amount, then tightening the opposite set screw, will cause the base 18 to rotate in the direction of the tightened set screw.

Figure 5:
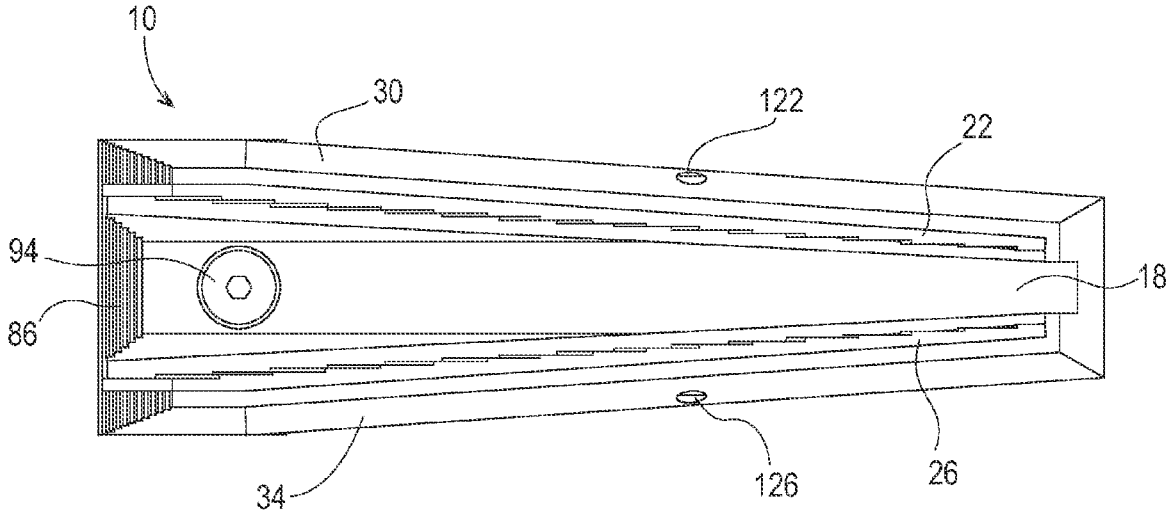
FIG. 5 is a top view of one embodiment.

FIG. 5 is a top view of the sight 10.

Figure 6:
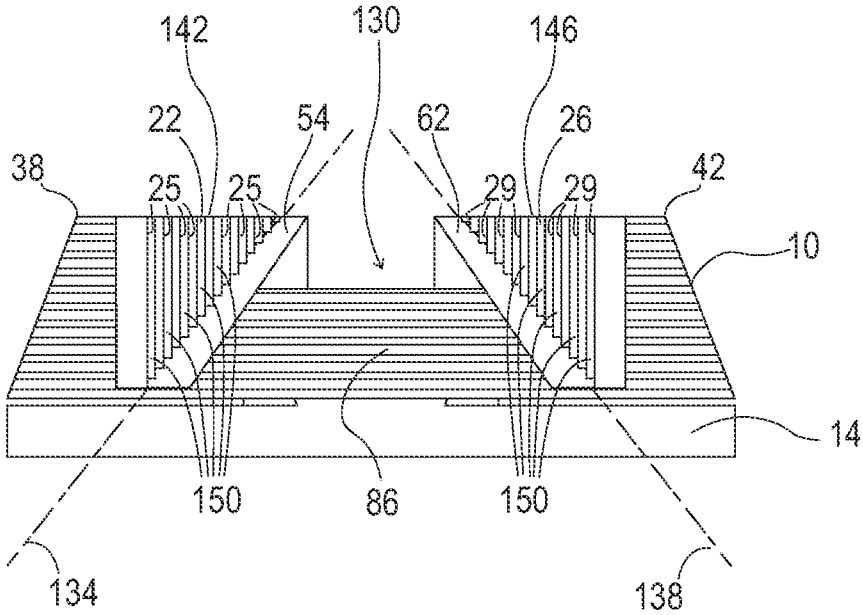
FIG. 6 is a rear or operator view of one embodiment.

Referring to FIG. 6, the tabs 22, 26 in one embodiment, are configured to exhibit a right triangle contrast geometry to the operator of the firearm. The surfaces 150, and the subsequently raised adjacent surfaces 25, 29, act collectively to form, from the point for view of the operator, the viewable contrast geometries which provide, based on their three dimensional properties, the visual cues that induce the operator to intuitively align the firearm when aiming at a target in the targeting space 130 between the two ramps 54, 62. The left-side right triangle generally comprises a left hypotenuse that lies along line 134, which also runs along the bottom surfaces of the raised adjacent surfaces 25. In addition, the ramp 54 also lines up with and is parallel to the hypotenuse 134. The right-side right triangle generally comprises a right hypotenuse that lies along line 138, which also runs along the bottom surfaces of the raised adjacent surfaces 29. In addition, the ramp 62 also lines up with and is parallel to the hypotenuse 138. This geometric visual shape, comprising the raised adjacent surfaces 25, 29, surfaces 150, hypotenuses 134, 138, and the ramps 54, 62, all work together to form a sight picture that induces the operator to naturally and intuitively align the firearm by seeking relevant geometric symmetries and configurations so that the targeting space 130 naturally lines up with the target the operator is aiming for. In addition, the front end 86, which may have a serrated surface, also will tend to guide the operator to line up the target at the targeting space 130. The presentation is such that, when viewed from behind and properly aligned with the firearm, an operator will see two symmetrical right triangles whose top legs 142, 146 are level and horizontally aligned with the target, and the hypotenuses 134, 138 are slanted upwards towards the targeting space 130. In other embodiments, the inner surfaces 24, 28 may be painted or coated with a highly distinguishable color such as but not limited to yellow, orange, white, etc.

Referring still to FIG. 6, surfaces 150 serve as the principle viewing surfaces of the contrast geometries when the firearm is properly aligned. In other words, when the firearm is properly aligned with the operator's sight view, the contrast geometries seen by the operator generally will be formed by the collective effect of surfaces 150. The surfaces 25 and 29, which are a byproduct of the angled surfaces 150, are generally not visible to the operator when the firearm is properly aligned to the operator's sight view, and generally become visible only when the firearm is misaligned with respect to the operator's sight view. When the firearm is misaligned as such, the surfaces 25 and 29 will then act collectively with surfaces 150 to form the contrast geometries viewable by the operator, such that the asymmetries and configuration deviations between the left and right contrast geometries are readily observable, and serve to suggest and induce corrective action to the operator who seeks to reestablish the desired geometric symmetry and configuration.

In one embodiment, the inner surfaces of the tabs 22 and 26 may be smooth, e.g. without the angled surfaces 150 and resulting surfaces 25 and 29. However, due to the high angle of incidence at which the tabs are viewed, the color contrast between the color of the tabs and the color of the rest of the device can be difficult to discern, as color contrast is generally highly functional of angle of incidence. In such a case, a user may not be able to sufficiently distinguish the tabs from the base and the rest of the device, even though the tabs may be painted a bright fluorescent distinguishing color with respect to the rest of the device. Thus one solution is to implement the beveled surfaces 150, whose primary purpose is to make viewing surfaces of the tabs that are orthogonal to the view of the operator, thereby eliminating the high angle of incidence of the tabs and making the tabs' color highly discernable. This geometrically results in the surfaces 25 and 29 as a byproduct, owing to a stair-step effect. In one embodiment, the surfaces 150 may be vertical, so as to minimize angle of incidence of the user's view of the tab thereby maximizing color contrast. In another, the surfaces 150 my be angled 45 degrees slanted forward, to reflect more ambient light from above into the view of the operator, in effect trading some angle of incidence for better light gathering. Thus, one possible purpose of the insteps 150 is to reduce the angle on incidence for the viewable portion of the tabs, thereby increasing the color contrast of the tabs and making them more visible to the user.

Figure 7:
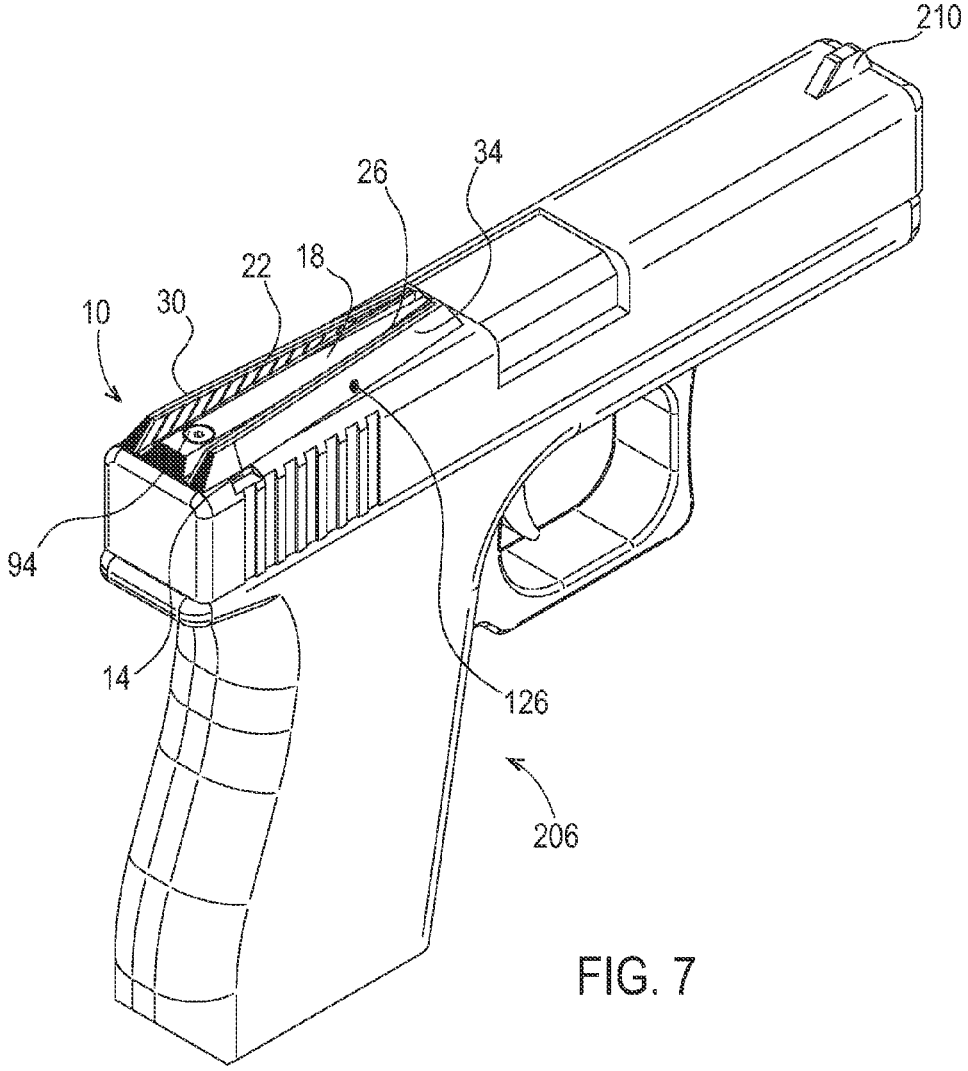
FIG. 7 is a perspective view of one embodiment mounted onto a firearm.
Figure 8:
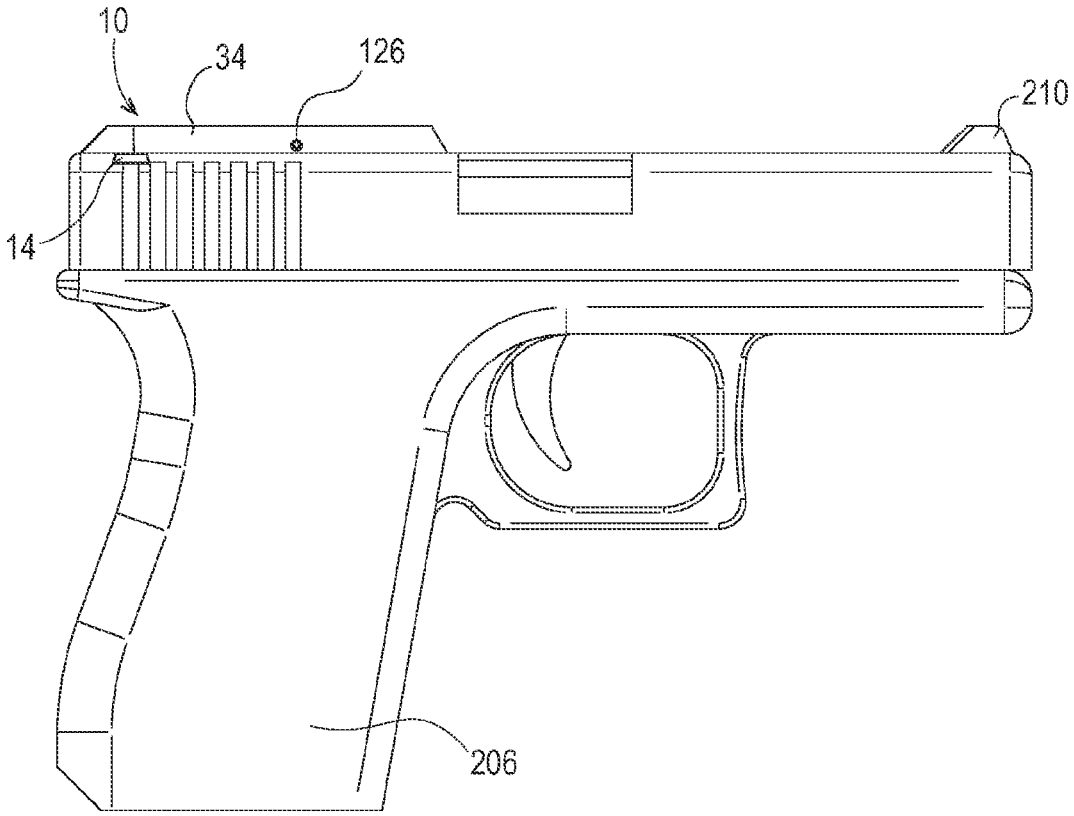
FIG. 8 is a side view of one embodiment mounted onto a firearm.
Figure 9:
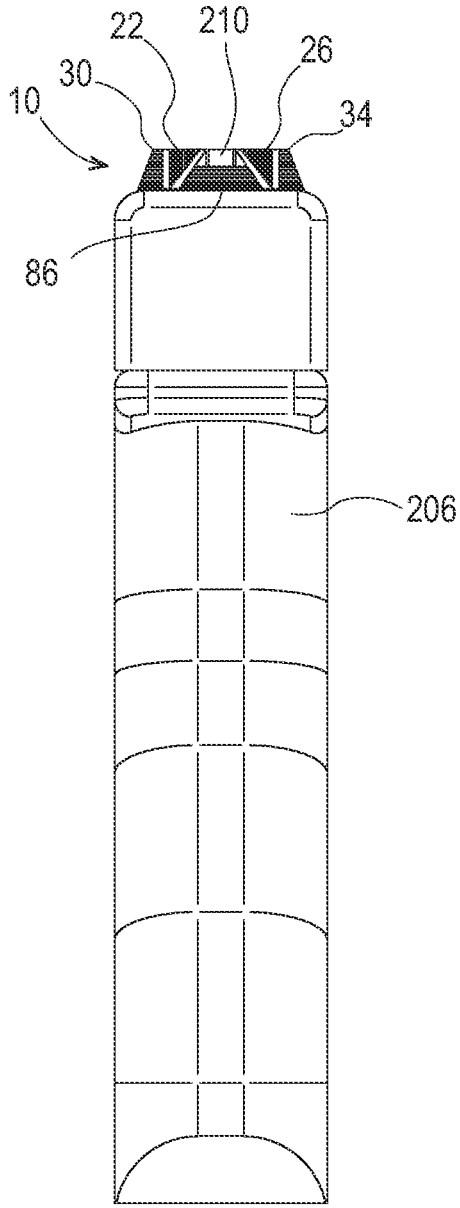
FIG. 9 is a rear view of one embodiment mounted onto a firearm.

FIG. 7 shows perspective view of an embodiment of the sight 10 attached to a firearm 206 where the firearm has a front sight 210. FIG. 8 shows a side view of the firearm 206 from FIG. 7. FIG. 9 is a rear view of the firearm 206 from FIG. 7.

Figure 10:
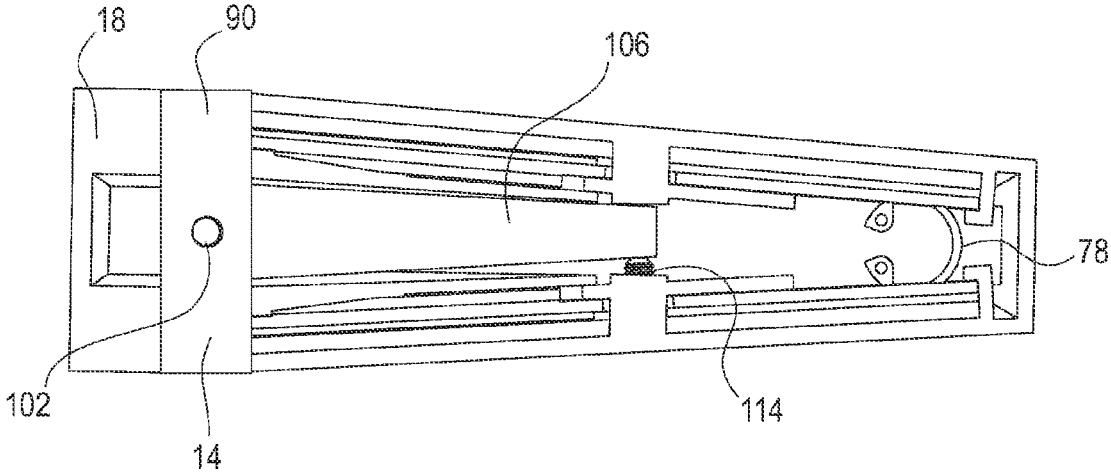
FIG. 10 is a bottom view of one embodiment with the base adjusted to a first angular position with respect to the mounting interface.
Figure 11:
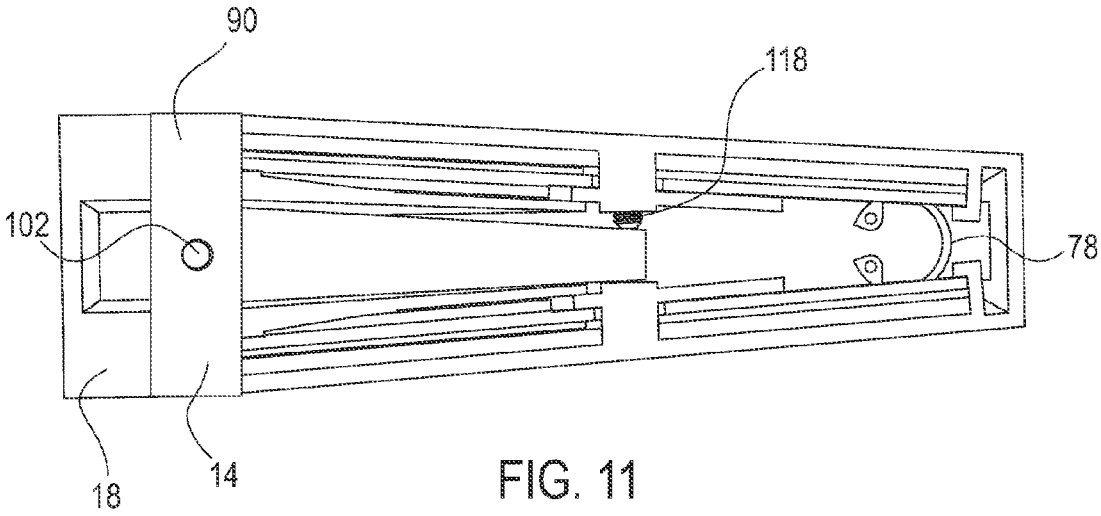
FIG. 11 is a bottom view of one embodiment with the base adjusted to a second angular position with respect to the mounting interface.

FIGS. 10 and 11 depict two angular orientations of the base 18 with respect to the extension arm 106 as described with respect to FIGS. 2 and 3 above. By fixing the angular position of the base 18 to the extension arm 106, the sight 10 can be directionally adjusted to take into account windage and thereafter rotationally secured with respect to the firearm. It should be obvious to one skilled in the art that such rotational calibration can be achieved by a multitude of alternative mechanical means, including use of worm screws, linear screws, a rack-and-pinion type arrangement, friction locking, gears, or other such means.

Figure 12:
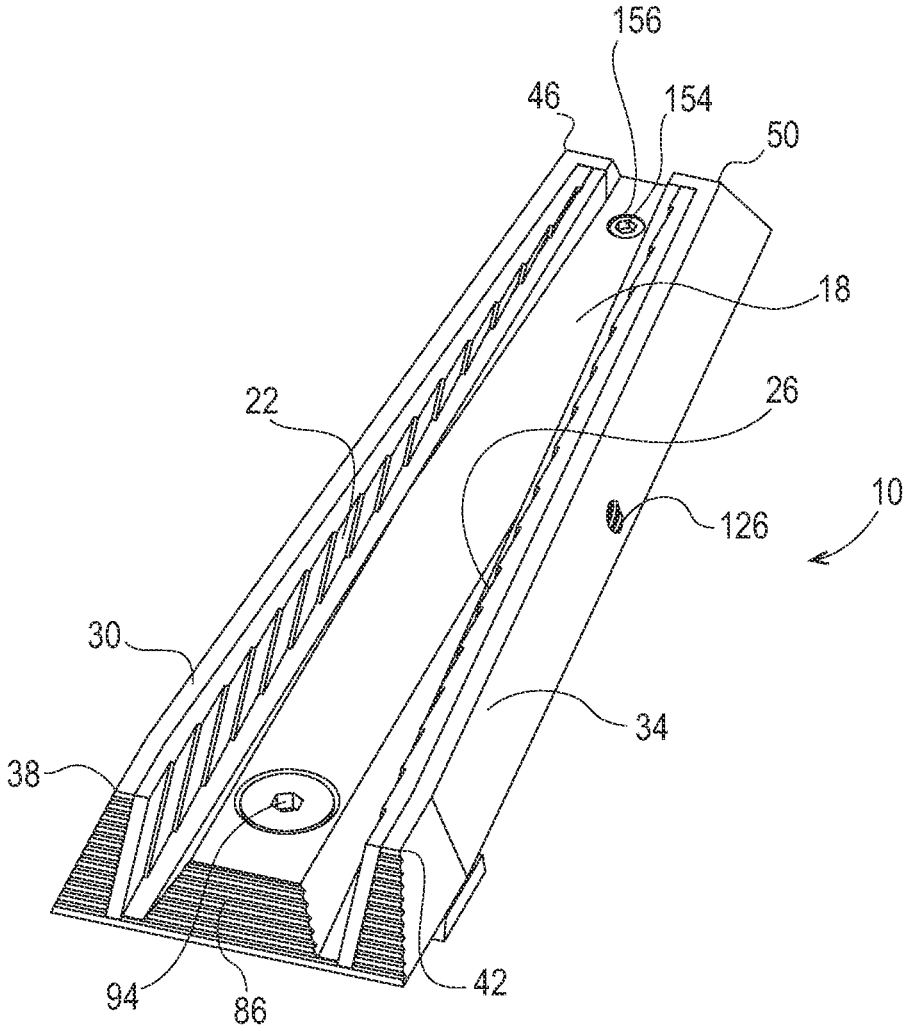
FIG. 12 is an upper perspective view of one embodiment with an elevation angle adjustment set screw.

In additional to the angular calibration required for windage, the device can be configured to adjust for elevation as well. FIG. 12 depicts an embodiment that includes an elevation set screw 154 threaded vertically through an elevation hole 156 adjacent to the firing end of the sight 10. This set screw 154 is configured such that its end-point is meant to rest on the top of the firearm, providing a support for the firing end of the base 18. By adjusting the depth of this set screw 154, the height of the firing end of the sight 10 can be raised or lowered with respect to the operator end of the sight 10, thus adjusting the angle of elevation of the sight 10 with respect to the firearm. Additionally, horizontal adjustment for windage can be accomplished by moving the sight from side to side in the dovetail slot of the firearm, and tightening screw 94 when the appropriate lateral windage correction is achieved. Accordingly, horizontal (lateral), vertical (elevation), and angular windage adjustments can be made. It should be obvious to those skilled in the art that a multitude of alternative means can be employed to achieve adjustments for windage, including those already employed for existing adjustable sights.

Figure 13:
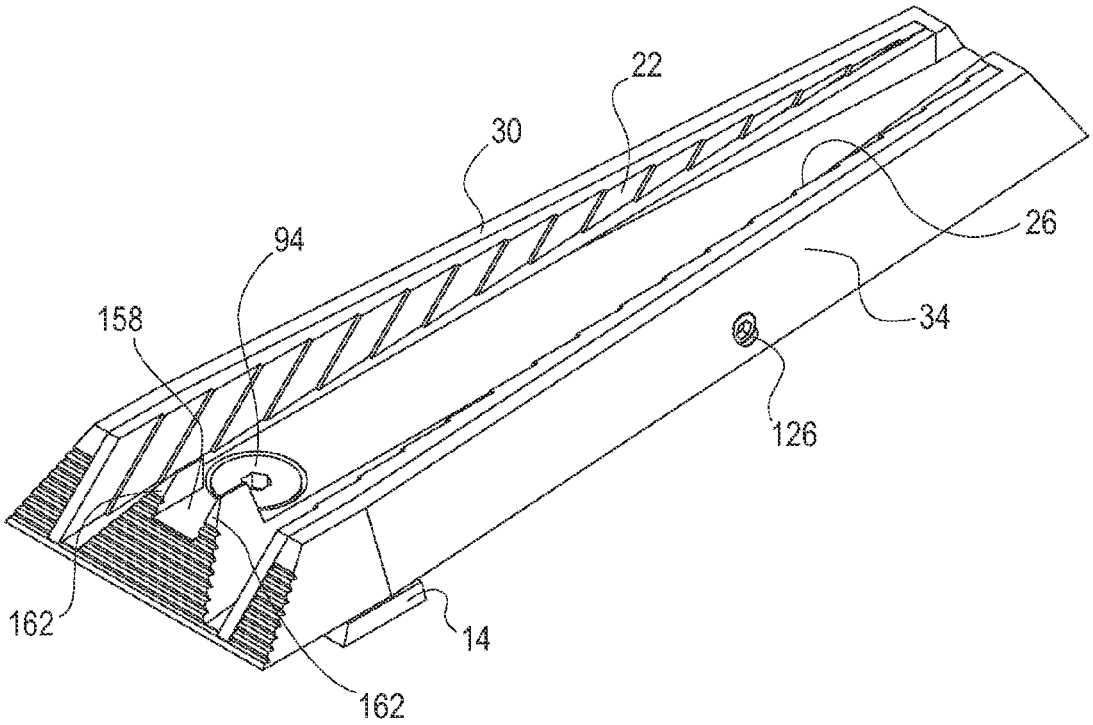
FIG. 13 is an upper perspective view of one embodiment with an optional rear notch structure and accompanying markings.

FIG. 13 depicts an optional "notch" structure 158 may be incorporated at the operator end of the sight 10 that provides for traditional "notch and post" sighting operations. Optionally, such a "notch" structure 158 may incorporate additional marking features 162 that highlight the position of the edges of the notch against the contrast geometries and the rest of the device. The "notch" structure 158 and accompanying optional marking features 162 allow for greater precision when using the sight in this configuration to align the firearm with a target.

Figure 14:
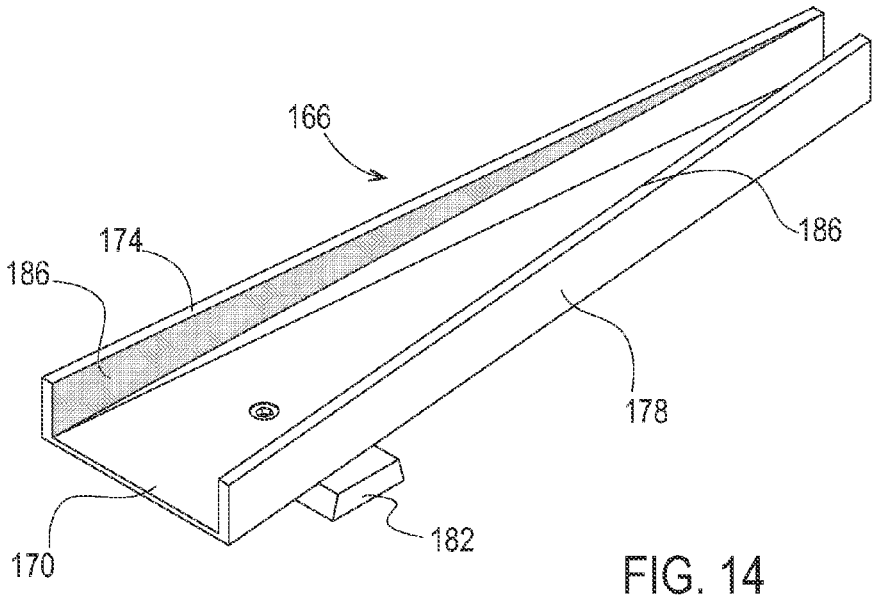
FIG. 14 is an upper perspective view of simplified embodiment configured with contrast geometries shaped in a right triangle configuration.

FIG. 14 is another embodiment of the disclosed sight 166. The sight 166 may be a simple one-piece design. Here, the one-piece simplified sight 166 conveys the essence of the invention in a low-cost, easy to manufacture embodiment that consists merely of a single base frame 170 comprised of the two vertical "V" shaped walls 174 and 178, an integrated and fixed mounting interface 182 and contrast geometries 186 that are imprinted on the vertical walls. The contrast geometries can be presented in a variety of colors and techniques, including painting, silk-screening, power-coating, potted epoxy, or any other method of visually distinguishing the contrast geometries with respect to the backing vertical base walls and the rest of the device, including the use of luminescent materials.

Figure 15:
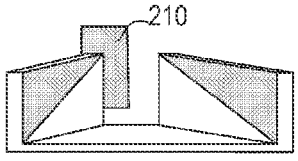
FIGS. 15-23 is a set of rear views for the simplified embodiment of FIG. 14 portraying what the operator would see in nine general alignment scenarios.
Figure 16:
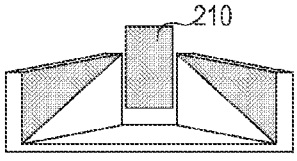
Figure 17:
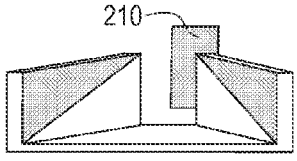
Figure 18:
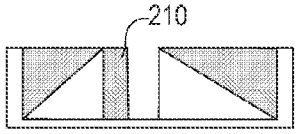
Figure 19:
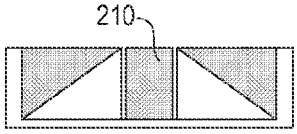
Figure 20:
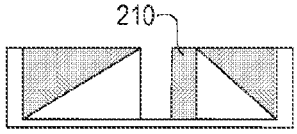
Figure 21:
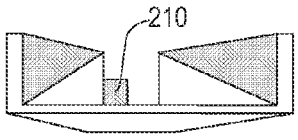
Figure 22:
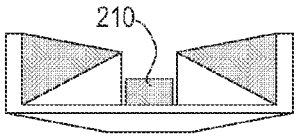
Figure 23:
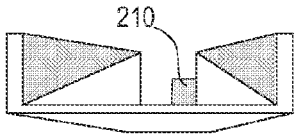

FIG. 15 depicts a generic presentation of views to the operator for the configuration shown in FIG. 14, portraying what the operator would see in nine general alignment scenarios with respect to a front sight 210. FIGS. 15 through 23, respectively, show the following orientations: high and left of target, high of target, high and right of target, left of target, on target, right of target, low and left of target, low of target, and low and right of target, hereafter collectively referred to as "the nine general alignment scenarios."

Figure 24:
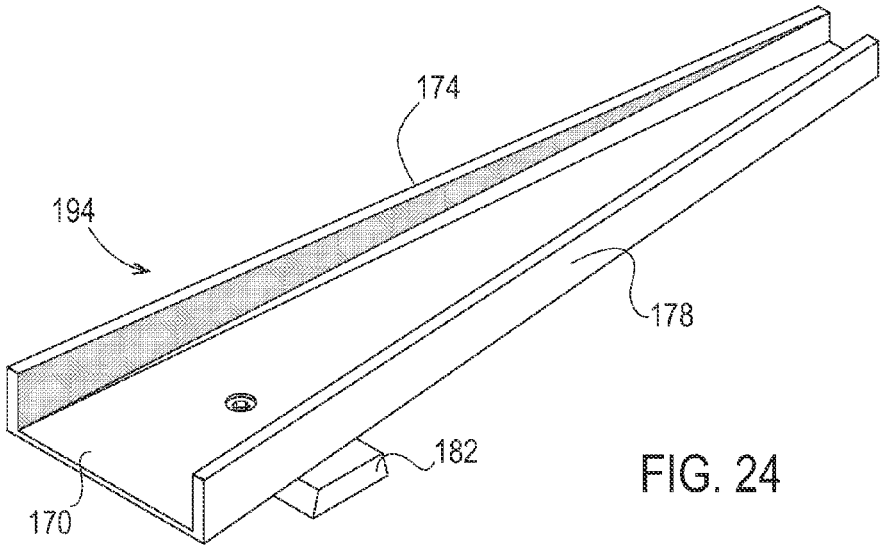
FIG. 24 is an upper perspective view of simplified embodiment configured with contrast geometries shaped in an isosceles triangle or hourglass configuration.
Figure 25:
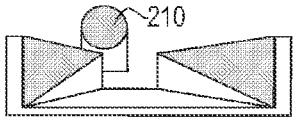
FIGS. 25-33 is a set of rear views for the simplified embodiment of FIG. 24 portraying what the operator would see in nine general alignment scenarios.
Figure 26:
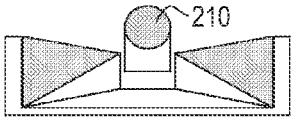
Figure 27:
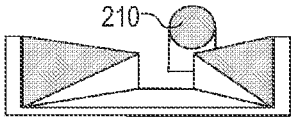
Figure 28:
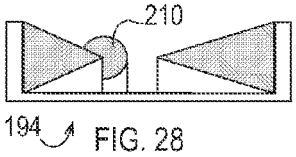
Figure 29:
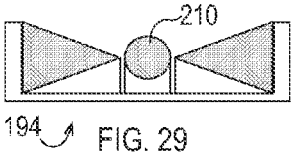
Figure 30:
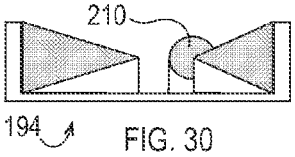
Figure 31:
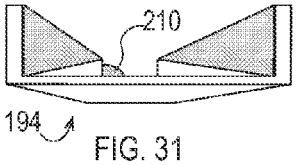
Figure 32:
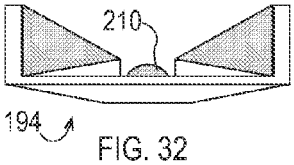
Figure 33:
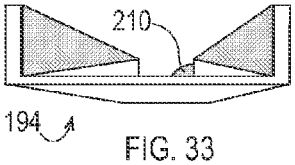
Figure 34:
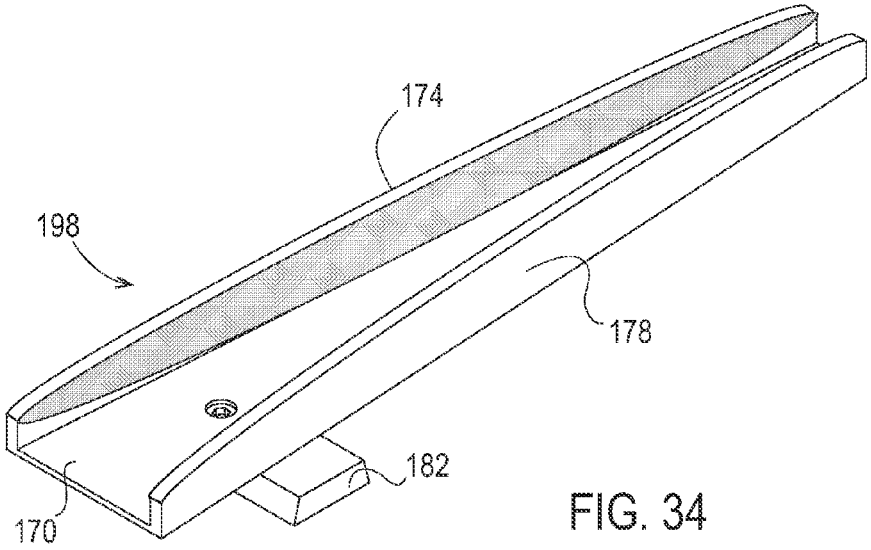
FIG. 34 is an upper perspective view of simplified embodiment configured with contrast geometries shaped in an elliptical configuration.
Figure 35:
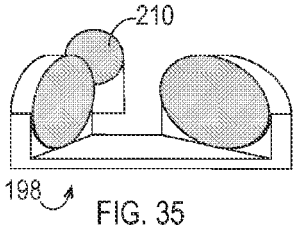
FIGS. 35-43 is a set of rear views for the simplified embodiment of FIG. 34 portraying what the operator would see in nine general alignment scenarios.
Figure 36:
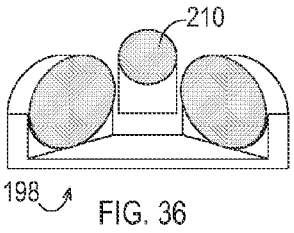
Figure 37:
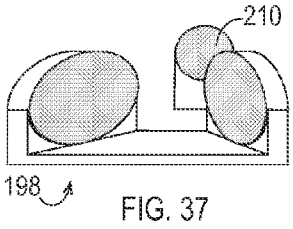
Figure 38:
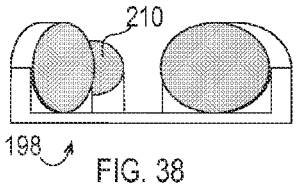
Figure 39:
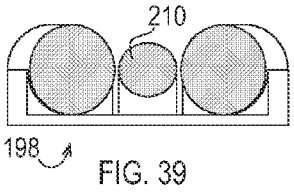
Figure 40:
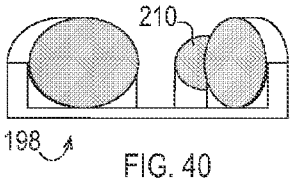
Figure 41:
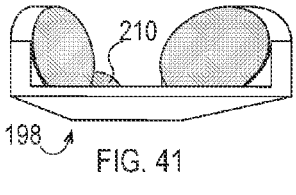
Figure 42:
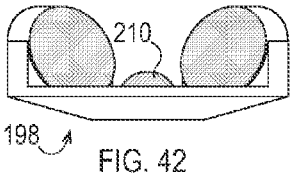
Figure 43:
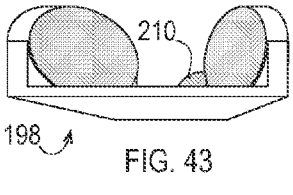
Figure 44:
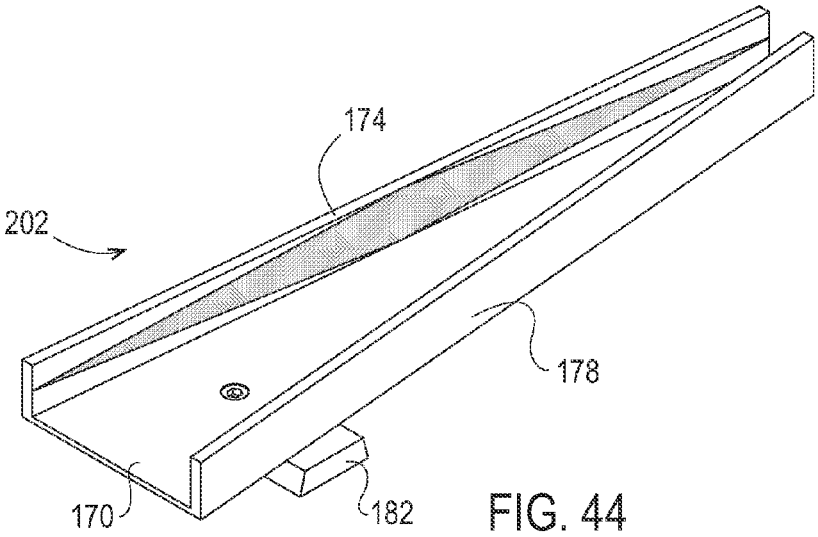
FIG. 44 is an upper perspective view of simplified embodiment configured with contrast geometries shaped in a diamond or rhombus configuration.
Figure 45:
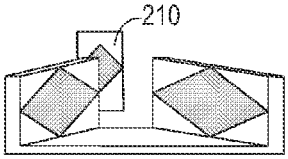
FIGS. 45-53 is a set of rear views for the simplified embodiment of FIG. 44 portraying what the operator would see in nine general alignment scenarios.
Figure 46:
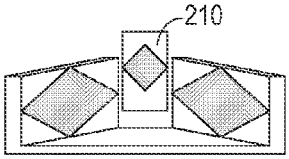
Figure 47:
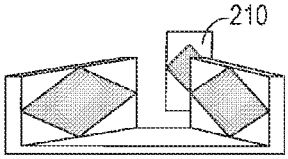
Figure 48:
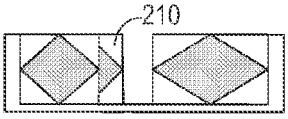
Figure 49:
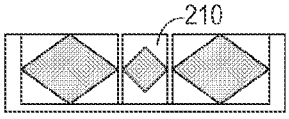
Figure 50:
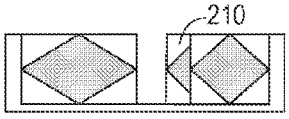
Figure 51:
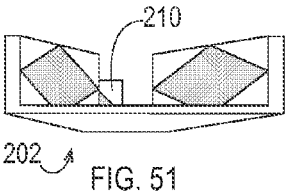
Figure 52:
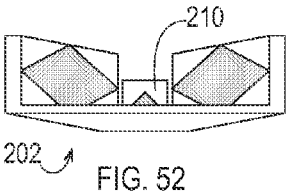
Figure 53:
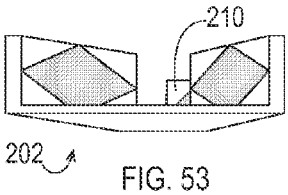

It should also be noted that the choice of contrast geometry need not be limited to a right triangle configuration of some of the previous embodiments, but rather can be any that provides meaningful or useful cues to the operator. FIG. 24, for instance, depicts another embodiment of the sight 194 the present invention utilizing an isosceles triangle or "hourglass" shaped contrast geometry configuration, with the added benefit that the portion of the side walls above the contrast geometry can be optionally removed and thus provide additional viewing area for target acquisition. FIGS. 25-33 depict the generic presentation of views to the operator of such a configuration, in the nine general alignment scenarios outlined above. In another example, FIG. 34 depicts an embodiment of the sight 198 where the contrast geometries are elliptically shaped, sized in such a manner that when the operator view is properly aligned with the sight, the ellipses appear as circles. FIGS. 35-43 depict the generic presentation of views to the operator of such a configuration, in the same nine general alignment scenarios. In yet another example, FIG. 44 depicts an embodiment of the sight 202 where the contrast geometries are shaped as diamonds or rhombuses. FIGS. 45-53 depict the generic presentation of views to the operator of such a configuration, in the same nine general alignment scenarios. It is not intended that these examples provide an exhaustive list of geometries that may be used in the present invention. In fact, any can be used. Further, the front sight 210 used in these presentations is purely optional, and can depict a multitude of geometries that complement the alignment of the base wall geometries chosen. For instance, a right triangle shaped geometry on the base walls may be paired with a more conventionally shaped rectangular front sight geometry, whereas the isosceles triangle or hourglass shaped geometry may be paired with a circularly shaped front sight geometry. Similarly, a diamond shaped base wall geometry may be paired with a diamond shaped front sight geometry, and an elliptically shaped base wall geometry may be paired with an elliptically shaped front sight geometry. Such pairings, however, are not intended to be definitive or all-inclusive, and choice of geometry pairs is left to preference of the operator in the context of the intended use.

Figure 54:
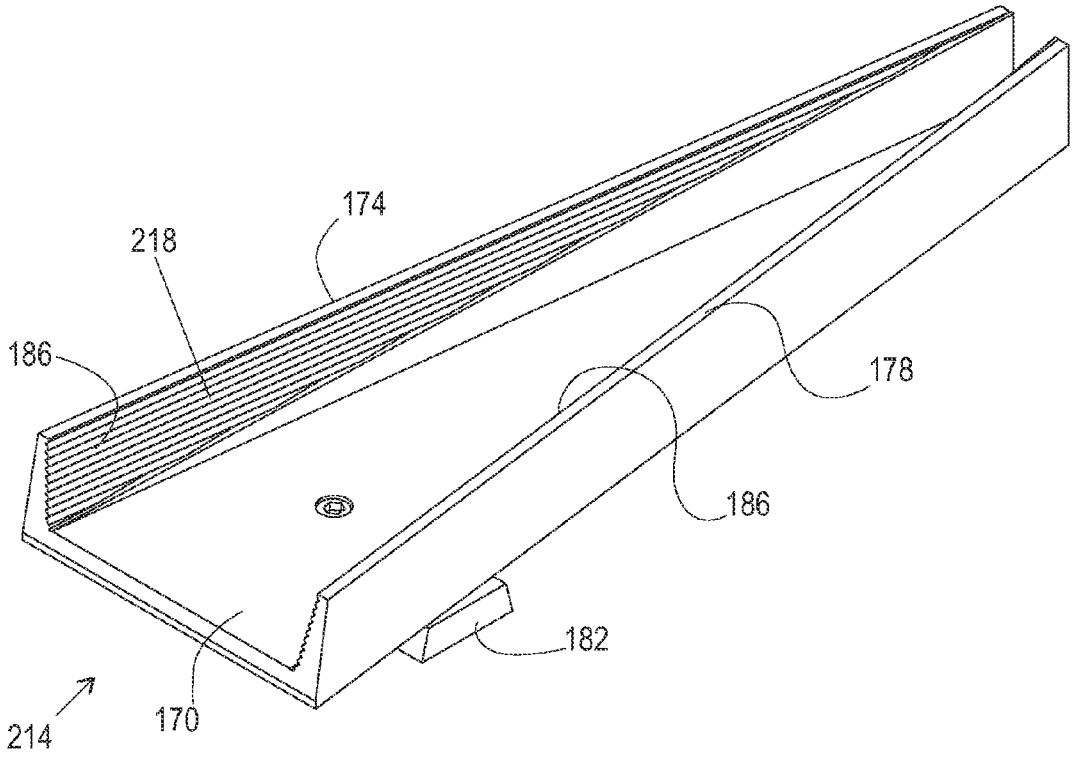
FIG. 54 is an upper perspective view of one embodiment using serrations to demark the contrast geometries.

The means of distinguishing the contrast geometries may also be accomplished by modifying the surface quality or surface finish of the vertical walls themselves, with or without color enhancement, such that the contrast geometries are distinguishable by the surface treatment alone. Such means may include embossing, etching, stamping, chemical treatment, sand blasting, texturing, or any other treatment or mechanical adornment that visibly alters the surface appearance of the walls, including embedding mechanical serrations on the surface. Further, the modified surface quality or finish can be incorporated as part of a mold, should molding techniques be used. FIG. 54 depicts one such sight 214 embodiment that employs generally horizontal mechanical serrations 218 on the inside surface of the vertical walls 174, 178 to distinguish the contrast geometries.

It should also be noted that the base structure and contrast geometries need not be opaque, but can also be translucent. The base structure, for instance, may be partially or fully translucent, and the contrast geometries may be either opaque, partially or fully translucent, and with or without color differentiation (tinting). The contrast geometries may also be distinguished by a surface treatment, such as etching, embossing, stamping, chemical treatment, texturing, or any other treatment or mechanical adornment that alters the visible appearance of the walls, including embedding mechanical serrations on the surface. Further, such distinguishing surface features may be incorporated as part of a mold, should molding techniques be used. There may be a tactical advantage to having translucent qualities to the device (made of clear and/or colored tinted plastic for instance), in that the sight, being translucent, provides for greater target visibility of what lies behind the sight structure.

The ramps 54, 62 may be a manufacturing by-product of the goal to make the tabs removable. In an embodiment needing slot structures into which to insert the tabs, the ramps exist principally because there are wall thickness limitations (e.g. minimum wall thicknesses) for most manufacturing methods. Because the slots need an outer wall, and that wall could only be so thin, the ramps are a natural outcome of the slot structure by serving as the outer wall for the slots. Further, the ramps may serve as a useful visual cue as well.

The disclosed invention has many advantages. One advantage is that the left and right contrast geometry walls each have an inner surface that has a visually contrasting appearance such that the user intuitively adjusts the firearm to cause the contrast geometry on the left wall and the contrast geometry on the right wall to appear symmetrical, equal in size and shape, and of a particular orientation, when the user properly aims the firearm at a target. For instance, if the left contrast geometry is a right triangle, and the right contrast geometry is a right triangle, the user will tend to adjust the firearm so that the two right triangles will appear as mirror images of each other with equal length legs and hypotenuses, and the angular orientation of the two right triangles are generally equal in a mirror image fashion. The disclosed firearm sight takes advantage of the mind's natural inclination to seek and establish symmetry. The firearm sight provides generally continuous, proportional, wide-angle "depth axis" visual cues. The sight's alignment orientation may be easily assessed with peripheral vision. The firearm sight provides easily discerned cues while the operators are focused on the target rather than the sight. The disclosed firearm sight offers faster, more precise, and more intuitive target acquisition capability than traditional post-and-notch sight systems by providing enhanced, geometric-based sight alignment information derived by incorporating depth axis (z axis that may be co-axial to the barrel) visual indicators of off-alignment direction and magnitude. The net effect of this device is to provide continuous, proportional, wide-angle, and intuitive visual indicators of the firearm alignment with respect to the operator's view and the target. The visual indication is a direct result of the three-dimensional geometry changes that occur when the firearm alignment is moved on and off target alignment. Alignment correction is proportionally and intuitively suggested by differences in the relative shapes and orientations of the contrast geometries. The system takes advantage of the human mind's natural ability to process three-dimensional orientations using depth perception, and to seek symmetry and balance in simple adjacent geometric shapes. In this way, the system seeks to provide maximum targeting capability and situation awareness to the operator while minimizing the cognitive effort required. When the operator's view of the sight is in proper alignment with the firearm, a particular and symmetrical desired geometric reference shape will come into view. This is an indication that the firearm is properly aligned with the operator's view, and will be properly aimed at a target positioned direction above and between the contrast geometries. However, when the operator's view of the sight is not in proper alignment with the firearm, the contrast geometries will be distorted from the desired reference shapes as determined by an off-axis three-dimensional translation of the shapes into the operator's two-dimensional plane of view. For instance, misalignment of the operator's view about the horizontal plane will cause the geometric shapes on the left and right sides to assume different sizes and shapes that are asymmetrical with respect to each other. Similarly, misalignment of the operator's view about the vertical plane will cause the geometric shapes to assume different vertical properties, such as non-colinearity of the otherwise collinear legs of the triangles (e.g. the top legs of the triangle will form a convex or concave orientation, depending on whether the operator is sighting too high or too low.) In seeking to re-establish the desired symmetries and properties of the reference geometry as viewed by the operator, the operator will naturally and intuitively adjust the firearm alignment until the desired symmetries are met. For instance, alignment about the horizontal plain will be adjusted to achieve shape symmetry (equal sizes and shapes) of the left and right translated reference geometries, in this case triangles. Similarly, alignment about the vertical plane will be adjusted to achieve the desired vertical reference geometry, in this case co-linearity of the tops of the translated triangles. In this manner, the operator will seek to orient the firearm in proper alignment with his sight view and the target of interest. This is particularly useful when the operator must properly align the firearm and acquire the target quickly, and can begin proper alignment of the firearm as it is being brought into position by acquiring a peripheral view of the sight and its contrast geometries early. The operator will naturally and intuitively orient the firearm in a correct alignment during the drawing phase by striving early on to achieve and sustain the correct reference geometry of the sight. As the firearm approaches its correct operating position, the natural tendency to acquire symmetrical reference geometries will cause the operator to make quick last second corrections to achieve proper firearm alignment with little cognitive thought. An additional advantage of the proposed sighting system comes about in consideration of the operator's natural eye focusing instincts. It is well known in the art that proper aiming technique requires the operator to bring the front sight into focus (e.g. the front sight should be optically focused by the operator) while aiming, causing the rear sight and (more importantly) the target to be out-of-focus, or blurry. While this may indeed be the best technique for aiming in a static target situation (e.g. competition target shooting) it is highly unlikely that, in a real tactical or defensive situation, the operator will maintain a focus in this manner. Rather, it is far more likely that the operator will maintain a focus on the target, i.e. the object of threat. The result is that the sighting system will generally be out-of-focus in tactical situations. In traditional "dual plane" sighting systems, the operator will likely have a difficult time assessing firearm alignment while the sighting system is out-of-focus and his attention is on the threat and not the sight. The present device overcomes this limitation by providing highly suggestive and easily discerned visual cues even while the attention of the operator is on the target (rather than the sights) and the sights are out-of-focus.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A firearm sight comprising:

a sight base;

a left contrast geometry wall extending generally upward from the sight base, the left contrast geometry wall having a left operator end and a left firing end;

a right contrast geometry wall extending generally upward from the sight base, the right contrast geometry wall having a right operator end and a right firing end, and wherein the left contrast geometry wall and right contrast geometry wall are tapered in position with respect to each other such that distance between the left operator end and the right operator end is greater than the distance between the left firing end and the right firing end;

a targeting space located generally between left and right firing ends;

a mounting interface attached to the underside of the base, and configured to attached to a top surface of a firearm;

a plurality of discrete surfaces comprising generally the inner surface of the left contrast geometry wall, wherein each subsequent adjacent discrete surface, beginning with the discrete surface adjacent to the left operator end is slightly raised with respect to the previous adjacent surface until the left firing end;

a plurality of discrete surfaces comprising generally the inner surface of the right contrast geometry wall, wherein each subsequent adjacent discrete surface, beginning with the discrete surface adjacent to the right operator end is slightly raised with respect to the previous adjacent surface until the right firing end; and wherein the left and right contrast geometry walls each have an inner surface that has a visually contrasting appearance such that user intuitively adjusts the firearm such that the contrast geometry on the left wall and the contrast geometry on the right wall appear equal in size, shape, and orientation to the user as the user aims the firearm.

2. The firearm sight of claim 1, further comprising:

a left ramp located adjacent to the left contrast geometry wall, the ramp rising generally from the left operator end until the left firing end, and wherein the upper surface of the ramp generally borders the lower surfaces of each discrete surface that comprises the inner surface of the left contrast geometry wall;

a right ramp located adjacent to the right contrast geometry wall, the ramp rising generally from the right operator end until the right firing end, and wherein the upper surface of the ramp generally borders the lower surfaces of each discrete surface that comprises the inner surface of the right contrast geometry wall.

3. The firearm sight of claim 2, further comprising:

a left-side right triangle, visible to an operator using the firearm sight, formed by the right angle formed by the intersection of the operator facing surface of the left contrast geometry wall and the top surface of the left contrast geometry wall, and the hypotenuse formed by the intersection of the left ramp and the discrete surfaces that comprise the inner surface of the left contrast geometry wall;

a right-side right triangle, visible to an operator using the firearm sight, formed by the right angle formed by the intersection of the operator facing surface of the right contrast geometry wall and the top surface of the right contrast geometry wall, and the hypotenuse formed by the intersection of the right ramp and the discrete surfaces that comprise the inner surface of the right contrast geometry wall; and wherein the hypotenuse lengths of both right triangles appear equal when the sight is properly targeted upon a target.

4. The firearm sight of claim 3, further comprising:

top legs of both right triangles appearing collinear and generally aligned with the target when the sight is properly targeted upon a target, and the left-side right triangle and right-side right triangle appear equal in size, shape, and orientation when the sight is properly targeted upon a target.

5. The firearm sight of claim 4, wherein the means of attaching the left contrast geometry wall to the base are selected from the group consisting of adhesives, snap joints, latches, clips, retaining rings, pins, screws, press-fit, and interference-fit; and wherein the means of attaching the right contrast geometry wall to the base are selected from the group consisting of adhesives, snap joints, latches, clips, retaining rings, pins, screws, press-fit, and interference-fit.

6. The firearm sight of claim 1, further comprising:

a left wall fixedly attached to the base;

a right wall fixedly attached to the base;

the left contrast geometry wall removably attachable to the base and when attached to the base, the left contrast geometry wall abutting the inner surface of the left wall; and the right contrast geometry wall removably attachable to the base and when attached to the base, the right contrast geometry wall abutting the inner surface of the right wall.

7. The firearm sight of claim 1, further comprising:

an image of an isosceles triangle on the a left contrast geometry wall;

an image of an isosceles triangle on the right contrast geometry wall where the height of both isosceles triangles appear equal to each other, and the four base angles appear equal to each other when the sight is properly targeted upon a target.

8. The firearm sight of claim 1, further comprising:

an image of an ellipse on the a left contrast geometry wall;

an image of an ellipse on the right contrast geometry wall where both ellipses appear as circles with equal diameters to each other when the sight is properly targeted upon a target.

9. The firearm sight of claim 1, further comprising:

an image of a rhombus on the a left contrast geometry wall;

an image of a rhombus the right contrast geometry wall where both rhombuses appear to have equal length sides when the sight is properly targeted upon a target.

10. The firearm sight of claim 1, wherein the inner surfaces of the left and right contrast geometry walls are painted or coated with a highly distinguishable color.

11. The firearm sight of claim 1, wherein the inner surfaces of the left and right contrast geometry walls haven been modified according to the means in the group consisting of applying visually distinguishing surface treatment, adding mechanical adornment, or adding texturing.

12. A firearm sight comprising:

a sight base;

a left contrast geometry wall extending generally upward from the sight base, the left contrast geometry wall having a left operator end and a left firing end;

a right contrast geometry wall extending generally upward from the sight base, the right contrast geometry wall having a right operator end and a right firing end, and wherein the left contrast geometry wall and right contrast geometry wall are tapered in position with respect to each other such that distance between the left operator end and the right operator end is greater than the distance between the left firing end and the right firing end;

a targeting space located generally between left and right firing ends;

a mounting interface attached to the underside of the base, and configured to attached to a top surface of a firearm;

a mounting hole located on the base near the operator end, and adjacent to the mounting interface, the mounting hole in generally a vertical orientation with respect to the base;

a mounting screw configured to go through the mounting hole and screw into the mounting interface;

a cavity located in the bottom of the base;

an extension arm extending from the mounting interface towards the firing end, and located generally within the cavity;

a left set screw hole located in the base, the left set screw hole located adjacent to the left side of the extension arm, the left set screw hole in generally a horizontal orientation with respect to the base;

a right set screw hole located in the base, the right set screw hole located adjacent to the right side of the extension arm, the right set screw hole in generally a horizontal orientation with respect to the base;

a left set screw configured to screw into the left set screw hole;

a right set screw configured to screw into the right set screw hole;

wherein the left and right contrast geometry walls each have an inner surface that has a visually contrasting appearance such that the user intuitively adjusts the firearm such that the contrast geometry on the left wall and the contrast geometry on the right wall appear equal in size, shape, and orientation to the user as the user aims the firearm; and wherein the sight can be adjusted by rotating generally the firing end of the sight with respect to the mounting hole by adjusting the left and right set screws.

13. A firearm sight comprising:

a sight base;

a left contrast geometry wall extending generally upward from the sight base, the left contrast geometry wall having a left operator end and a left firing end;

a right contrast geometry wall extending generally upward from the sight base, the right contrast geometry wall having a right operator end and a right firing end, and wherein the left contrast geometry wall and right contrast geometry wall are tapered in position with respect to each other such that distance between the left operator end and the right operator end is greater than the distance between the left firing end and the right firing end;

a targeting space located generally between left and right firing ends;

a mounting interface attached to the underside of the base, and configured to attached to a top surface of a firearm;

a mounting hole located on the base near the operator end, and adjacent to the mounting interface, the mounting hole in generally a vertical orientation with respect to the base;

a mounting screw configured to go through the mounting hole and screw into the mounting interface;

an elevation hole located near the firing end of the base, and the elevation hole in generally a vertical orientation with respect to the base;

an elevation set screw configured to screw into the elevation hole;

wherein the left and right contrast geometry walls each have an inner surface that has a visually contrasting appearance such that the user intuitively adjusts the firearm such that the contrast geometry on the left wall and the contrast geometry on the right wall appear equal in size, shape, and orientation to the user as the user aims the firearm; and wherein the elevation set screw can be adjusted with respect to the elevation hole such that the firing end of the sight can be raised or lowered with respect to the firearm.

* * * * *